US011380257B2

(12) United States Patent
Xu et al.

(10) Patent No.: US 11,380,257 B2
(45) Date of Patent: Jul. 5, 2022

(54) DISPLAY PANEL AND DISPLAY DEVICE

(71) Applicants: BEIJING BOE TECHNOLOGY DEVELOPMENT CO., LTD., Beijing (CN); BOE TECHNOLOGY GROUP CO., LTD., Beijing (CN)

(72) Inventors: Chen Xu, Beijing (CN); Xueguang Hao, Beijing (CN); Yong Qiao, Beijing (CN); Xinyin Wu, Beijing (CN)

(73) Assignees: BEIJING BOE TECHNOLOGY DEVELOPMENT CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 543 days.

(21) Appl. No.: 16/477,308

(22) PCT Filed: Jan. 10, 2019

(86) PCT No.: PCT/CN2019/071187
§ 371 (c)(1),
(2) Date: Jul. 11, 2019

(87) PCT Pub. No.: WO2019/218713
PCT Pub. Date: Nov. 21, 2019

(65) Prior Publication Data

US 2021/0407402 A1 Dec. 30, 2021

(30) Foreign Application Priority Data

May 14, 2018 (CN) ..... 201820713468.9

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01);
(Continued)

(58) Field of Classification Search
CPC ..... G09G 3/32–3291; G09G 2300/0809–0876
See application file for complete search history.

(56) References Cited

U.S. PATENT DOCUMENTS 9,911,384 B2 * 3/2018 Park ..... G09G 3/3266
10,192,938 B2 * 1/2019 Yu ..... H01L 27/3276
(Continued)

FOREIGN PATENT DOCUMENTS

CN 103514834 A 1/2014
CN 104064148 A 9/2014
(Continued)

OTHER PUBLICATIONS

The Extended European Search Report dated Nov. 19, 2021; Appln. No. 19734657.0.
(Continued)

*Primary Examiner* — Patrick F Marinelli

(57) ABSTRACT

A display panel and a display device. The display panel includes a pixel circuit structure, a data line and a voltage signal line. The data line is connected to the pixel circuit structure to provide a data signal; the voltage signal line is connected to the pixel circuit structure to provide a voltage signal, the voltage signal is a constant voltage signal; the pixel circuit structure includes a first stabilization capacitor provided between the data line and the voltage signal line.

19 Claims, 4 Drawing Sheets

(52) U.S. Cl.
CPC ..... *G09G 2300/0842* (2013.01); *G09G 2300/0852* (2013.01); *G09G 2300/0861* (2013.01); *G09G 2320/0214* (2013.01); *G09G 2320/043* (2013.01)

(56) References Cited

U.S. PATENT DOCUMENTS 10,354,592 B2 * 7/2019 Han ..... H01L 27/1218
10,540,927 B2 * 1/2020 Park ..... G09G 3/3233
10,586,496 B2 * 3/2020 Kim ..... G09G 3/3275
10,699,619 B1 * 6/2020 Ma ..... G09G 3/20
10,733,934 B2 * 8/2020 Lee ..... G09G 3/3233
10,748,317 B2 * 8/2020 Park ..... G06T 7/90
10,789,891 B2 * 9/2020 Feng ..... G09G 3/3233
11,062,645 B1 * 7/2021 Xu ..... G09G 3/32
11,074,856 B2 * 7/2021 Zhao ..... G09G 3/3266
11,094,254 B2 * 8/2021 Ueno ..... G09G 3/3233
2007/0273619 A1 * 11/2007 Kitazawa ..... G09G 3/3233 345/76
2011/0279049 A1 * 11/2011 Kawabe ..... G09G 3/3233 315/228
2011/0292019 A1 * 12/2011 Yamamoto ..... G09G 3/3258 345/211
2011/0310137 A1 * 12/2011 Kajiyama ..... G09G 3/3225 345/690
2013/0257698 A1 10/2013 Toya et al.
2014/0002332 A1 1/2014 Huang et al.
2014/0062988 A1 3/2014 Lee et al.
2014/0111563 A1 * 4/2014 Hwang ..... H04N 13/398 345/691
2014/0203262 A1 * 7/2014 Kwak ..... G09G 3/3233 257/40
2014/0307010 A1 10/2014 Han
2014/0320476 A1 * 10/2014 Choi ..... G09G 3/3258 345/212
2015/0206933 A1 7/2015 Koshihara et al.
2016/0365035 A1 * 12/2016 Park ..... G09G 3/3266
2017/0011682 A1 1/2017 Pyo et al.
2018/0204889 A1 * 7/2018 Yu ..... H01L 27/3223
2018/0226023 A1 * 8/2018 Park ..... G09G 3/3233
2018/0293944 A1 * 10/2018 Kim ..... G09G 3/3275
2019/0066587 A1 * 2/2019 Han ..... H01L 27/1218
2019/0347997 A1 * 11/2019 Park ..... G09G 3/3266
2020/0005712 A1 * 1/2020 Lee ..... G09G 3/3233
2020/0074708 A1 * 3/2020 Park ..... G06K 9/4604
2020/0090592 A1 * 3/2020 Feng ..... G09G 3/3258
2020/0211432 A1 * 7/2020 Ma ..... G09G 3/3233
2020/0388217 A1 * 12/2020 Yuan ..... G09G 3/3208
2021/0043135 A1 * 2/2021 Zhao ..... G09G 3/3275
2021/0056901 A1 * 2/2021 Ueno ..... G09G 3/3275
2021/0065624 A1 * 3/2021 Li ..... G09G 3/325
2021/0134899 A1 * 5/2021 Peng ..... H01L 51/5234
2021/0142707 A1 * 5/2021 Zheng ..... G09G 3/035
2021/0167161 A1 * 6/2021 Yang ..... H01L 27/326
2021/0193025 A1 * 6/2021 Xu ..... G09G 3/3677
2021/0272508 A1 * 9/2021 Fujii ..... G09G 3/3233
2021/0295781 A1 * 9/2021 Kim ..... G09G 3/3275

FOREIGN PATENT DOCUMENTS

CN 105096838 A 11/2015
CN 105679236 A 6/2016
CN 208335702 U 1/2019

OTHER PUBLICATIONS

International Search Report and Written Opinion dated Apr. 3, 2019; PCT/CN2019/071187.

* cited by examiner

DISPLAY PANEL AND DISPLAY DEVICE

The present application claims priority to Chinese patent application No. 201820713468.9, filed on May 14, 2018, the entire disclosure of which is incorporated herein by reference as part of the present application.

TECHNICAL FIELD

Embodiments of the present disclosure relate to a display panel and a display device.

BACKGROUND

In the field of display, organic light emitting diode (OLED) display panels have characteristics of self-luminous, high contrast, low energy consumption, wide viewing angle, fast response, applicable for flexible panels, wide operating temperature range and simple manufacturing, and have broad development prospects.

SUMMARY

Embodiments of the present disclosure provide a display panel and a display device.

An embodiment of the present disclosure provides a display panel, which includes a pixel circuit structure, a data line and a voltage signal line, wherein the data line is connected to the pixel circuit structure to provide a data signal; the voltage signal line is connected to the pixel circuit structure to provide a voltage signal, the voltage signal is a constant voltage signal; the pixel circuit structure includes a first stabilization capacitor provided between the data line and the voltage signal line.

For example, the display panel further includes a gate line and a light emitting element. The gate line is connected to the pixel circuit structure to provide a scan signal; the pixel circuit structure further includes a driving transistor, the driving transistor is electrically connected to the light emitting element and outputs a driving current to drive the light emitting element to emit light under control of the scan signal and the data signal.

For example, a capacitance value of the first stabilization capacitor is equal to or greater than 10 times of a capacitance value of a parasitic capacitance between the data line and a gate electrode of the driving transistor.

For example, the first stabilization capacitor includes a first capacitor electrode and a second capacitor electrode, the first capacitor electrode is electrically connected to the voltage signal line, and the second capacitor electrode is electrically connected to the data line.

For example, the display panel further includes a substrate. The pixel circuit structure, the gate line, the data line and the voltage signal line are on the substrate, the first capacitor electrode and the second capacitor electrode overlap with each other in a direction perpendicular to the substrate.

For example, the voltage signal line and the data line are disposed in a same layer and extend in a same direction, the first capacitor electrode is located on a side of the data line close to the substrate; the display panel further includes an interlayer insulation layer between the data line and the first capacitor electrode, the first capacitor electrode is connected to the voltage signal line through a via hole penetrating through the interlayer insulation layer.

For example, the display panel further includes a compensation transistor. A first electrode and a second electrode of the driving transistor are respectively connected to the voltage signal line and the light emitting element; a first electrode and a second electrode of the compensation transistor are respectively connected to the second electrode and a gate electrode of the driving transistor, and a gate electrode of the compensation transistor is connected to the gate line.

For example, the compensation transistor includes an active layer, the active layer includes a first electrode region, a second electrode region, and a channel region between the first electrode region and the second electrode region, the first electrode region and the second electrode region are conductive regions, the display panel further includes a first connecting electrode, the first connecting electrode connects the second electrode region and the gate electrode of the driving transistor.

For example, the pixel circuit structure further includes a storage capacitor, a first electrode and a second electrode of the storage capacitor are electrically connected to the voltage signal line and the gate electrode of the driving transistor, respectively; the first electrode of the storage capacitor is disposed in the same layer as the first capacitor electrode, and overlaps with the gate electrode of the driving transistor in the direction perpendicular to the substrate.

For example, the first electrode of the storage capacitor and the data line overlap with each other in the direction perpendicular to the substrate.

For example, the first electrode of the storage capacitor is provided with an opening, and the first connecting electrode is electrically connected to the gate electrode of the driving transistor through the opening.

For example, the pixel circuit structure further includes a second stabilization capacitor, the second stabilization capacitor is located between the data line and the first electrode of the driving transistor, or the second stabilization capacitor is located between the voltage signal line and the first electrode of the driving transistor; or, the pixel circuit structure further includes a second stabilization capacitor and a third stabilization capacitor, one of the second stabilization capacitor and the third stabilization capacitor is located between the data line and the first electrode of the driving transistor, and the other of the second stabilization capacitor and the third stabilization capacitor is located between the voltage signal line and the first electrode of the driving transistor.

For example, the display panel further includes a light emitting control signal line, a reset control signal line and an initialization signal line, and the pixel circuit structure further includes a data writing transistor, a first light emitting control transistor, a second light emitting control transistor, a first reset transistor and a second reset transistor, wherein a first electrode and a second electrode of the data writing transistor are electrically connected to the data line and the first electrode of the driving transistor, respectively, and a gate electrode of the data writing transistor is electrically connected to the gate line; a gate electrode of the first light emitting control transistor is electrically connected to the light emitting control signal line, a first electrode and a second electrode of the first light emitting control transistor are electrically connected to the voltage signal line and the first electrode of the driving transistor, respectively; a gate electrode of the second light emitting control transistor is electrically connected to the light emitting control signal line, a first electrode and a second electrode of the second light emitting control transistor are electrically connected to the second electrode of the driving transistor and the first electrode of the light emitting element, respectively; a gate electrode of the first reset transistor is electrically connected to the reset control signal line, a first electrode and a second electrode of the first reset transistor are electrically connected to the initialization signal line and the gate electrode of the driving transistor, respectively; a gate electrode of the second reset transistor is electrically connected to the reset control signal line, a first electrode and a second electrode of the second reset transistor are electrically connected to the initialization signal line and the first electrode of the light emitting element, respectively.

For example, the voltage signal line includes a power line.

An embodiment of the present disclosure also provides a display panel, which includes a substrate, and a pixel circuit structure, a light emitting element, a gate line, a data line, a first power line, a second power line, a light emitting control signal line, an initialization signal line and a reset control signal line on the substrate, the pixel circuit structure including a storage capacitor, a driving transistor, a data writing transistor, a compensation transistor, a first light emitting control transistor, a second light emitting control transistor, a first reset transistor and a second reset transistor, wherein a first electrode of the storage capacitor is electrically connected to the first power line, a second electrode of the storage capacitor is electrically connected to a second electrode of the compensation transistor through a first connecting electrode; a gate electrode of the data writing transistor is electrically connected to the gate line, a first electrode and a second electrode of the data writing transistor are electrically connected to the data line and a first electrode of the driving transistor, respectively; a gate electrode of the compensation transistor is electrically connected to the gate line, the first electrode and a second electrode of the compensation transistor are electrically connected to a second electrode and a gate electrode of the driving transistor, respectively; a gate electrode of the first light emitting control transistor is electrically connected to the light emitting control signal line, a first electrode and a second electrode of the first light emitting control transistor are electrically connected to the first power line and the first electrode of the driving transistor, respectively; a gate electrode of the second light emitting control transistor is electrically connected to the light emitting control signal line, a first electrode and a second electrode of the second light emitting control transistor are electrically connected to the second electrode of the driving transistor and the first electrode of the light emitting element, respectively; a gate electrode of the first reset transistor is electrically connected to the reset control signal line, a first electrode and a second electrode of the first reset transistor are electrically connected to the initialization signal line and the gate electrode of the driving transistor, respectively; a gate electrode of the second reset transistor is electrically connected to the reset control signal line, a first electrode and a second electrode of the second reset transistor are electrically connected to the initialization signal line and the first electrode of the light emitting element, respectively; a second electrode of the light emitting element is electrically connected to the second power line; the pixel circuit structure further includes a first stabilization capacitor located between the data line and the first power line, the first stabilization capacitor includes a first capacitor electrode, and the first power line is configured to provide a constant voltage signal for the pixel circuit structure.

For example, the gate line, the gate electrode of the driving transistor and the second electrode of the storage transistor are disposed in a same layer; the first capacitor electrode, the initialization signal line and the first electrode of the storage transistor are disposed in a same layer; the data line, the first power line and the first connecting electrode are disposed in a same layer; the first capacitor electrode and the data line overlap with each other in a direction perpendicular to the substrate.

For example, the compensation transistor and the first reset transistor are metal oxide semiconductor thin film transistors or double gate thin film transistors.

For example, the first capacitor electrode is electrically connected to the first power line, the first stabilization capacitor further includes a second capacitor electrode, the second capacitor electrode is electrically connected to the data line, the first capacitor electrode and the second capacitor electrode overlap with each other in a direction perpendicular to the substrate.

For example, the first capacitor electrode is located on a side of the data line close to the substrate; the display panel further includes an interlayer insulation layer between the data line and the first capacitor electrode, the first capacitor electrode is connected to the first power line through a via hole penetrating through the interlayer insulation layer.

For example, the first electrode of the storage capacitor and the gate electrode of the driving transistor overlap with each other in a direction perpendicular to the substrate; the first electrode of the storage capacitor and the data line overlap with each other in the direction perpendicular to the substrate; an opening is disposed in the first electrode of the storage capacitor, and the first connecting electrode is electrically connected to the gate electrode of the driving transistor through the opening.

For example, the pixel circuit structure further includes a second stabilization capacitor, the second stabilization capacitor is located between the data line and the first electrode of the driving transistor, or the second stabilization capacitor is located between the first power line and the first electrode of the driving transistor; or, the pixel circuit structure further includes a second stabilization capacitor and a third stabilization capacitor, one of the second stabilization capacitor and the third stabilization capacitor is located between the data line and the first electrode of the driving transistor, and the other of the second stabilization capacitor and the third stabilization capacitor is located between the first power line and the first electrode of the driving transistor.

An embodiment of the present disclosure also provides a display device, which includes the display panel mentioned above.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1:
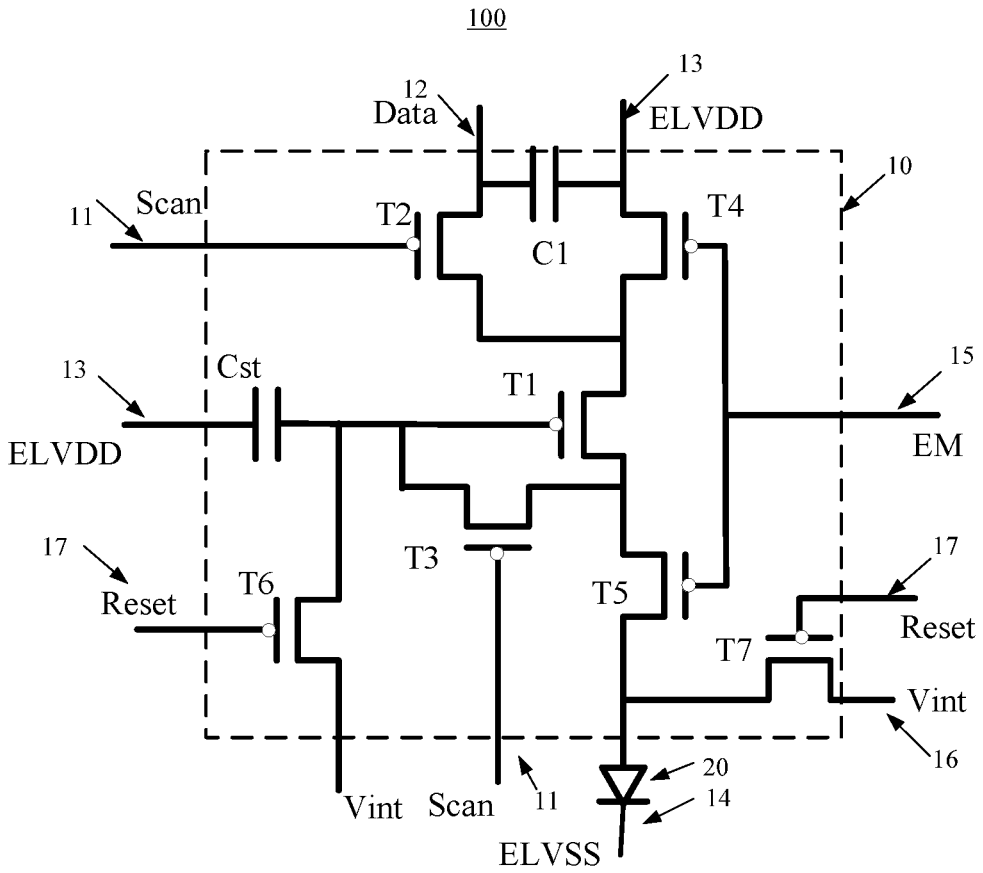
FIG. 1 is a schematic structural diagram of a display panel provided by an embodiment of the present disclosure.

Technical solutions in the embodiments of the present disclosure will be clearly and completely described with reference to the accompanying drawings. With reference to the non-limiting embodiments shown in the drawings and detailed in the following description, exemplary embodiments of the present disclosure and various features and advantageous details thereof will be described more fully below. It should be noted that the features shown in the figures are not necessarily drawn to scale. The present disclosure omits the description of known materials, components, and process techniques, so as not to obscure the exemplary embodiments of the present disclosure. The examples are given only to facilitate an understanding of the implementations of the exemplary embodiments of the present disclosure, and to further enable those skilled in the art to implement the exemplary embodiments. Therefore, the examples should not be construed as limiting the scope of the embodiments of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. In addition, in the various embodiments of the present disclosure, the same or similar reference numerals denote the same or similar components.

In a pixel unit of an organic light emitting diode display panel, a driving transistor is connected to an organic light emitting element, and outputs a driving current to the organic light emitting element under the control of signals such as a data signal and a scan signal, thereby driving the organic light emitting element to emit light. Because the magnitude of a gate voltage of the driving transistor is directly related to the magnitude of the driving current of the organic light emitting element, the stabilization of the gate signal is an important factor for achieving stable light emission of the organic light emitting element and stable display of the display panel.

In research, an inventor of the present application has found that when the data signal is transmitted on the data line, the fluctuation of the data signal easily interferes with the gate signal of the driving transistor. For example, the data signal interferes with the gate signal through a parasitic capacitance formed between the data line and the gate electrode of the driving transistor, thereby affecting the stability of the gate signal.

Figure 2:
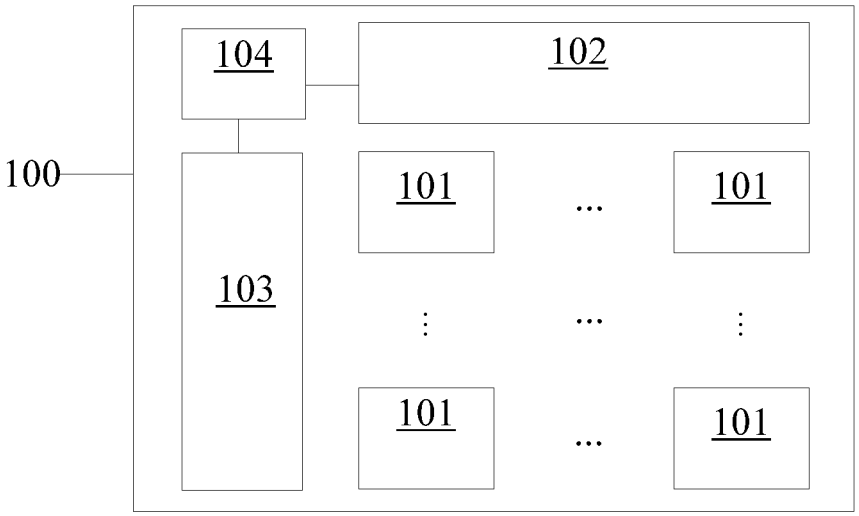
FIG. 2 is a schematic plan view of a display panel provided by an embodiment of the present disclosure.

FIG. 1 is a schematic structural diagram of a display panel provided by an embodiment of the present disclosure, and FIG. 2 is a schematic plan view of a display panel provided by an embodiment of the present disclosure. Referring to FIG. 1 and FIG. 2 together, the display panel 100 includes a plurality of pixel units 101 arranged in a matrix, and each of the plurality of pixel units 101 includes a pixel circuit structure 10, a light emitting element 20, a gate line 11, a data line 12, and a voltage signal line. The light emitting element 20 is an organic light emitting element OLED, and the light emitting element 20 emits red light, green light, blue light, or white light, etc., when driven by a corresponding pixel circuit structure 10 thereof. The voltage signal line can be one or more. For example, as shown in FIG. 1, the voltage signal line can include signal lines that provide a constant voltage signal, such as a first power line 13, a second power line 14, and an initialization signal line 16, etc.

For example, the first power line 13 is configured to provide a constant first voltage signal ELVDD to the pixel circuit structure 10, the second power line 14 is configured to provide a constant second voltage signal ELVSS, and the first voltage signal ELVDD is greater than the second voltage signal ELVSS. The light emitting control signal line 15 is configured to provide a light emitting control signal EM. The initialization signal line 16 and a reset control signal line 17 are respectively configured to provide an initialization signal Vint and a reset control signal Reset. The initialization signal Vint is a constant voltage signal, the magnitude of which can be, for example, between the first voltage signal ELVDD and the second voltage signal ELVSS, but is not limited thereto. For example, the initialization signal Vint can also be less than or equal to the second voltage signal ELVSS.

The pixel circuit structure 10 includes a driving transistor T1, a data writing transistor T2, a compensation transistor T3, a first light emitting control transistor T4, a second light emitting control transistor T5, a first reset transistor T6, a second reset transistor T7, and a storage capacitor Cst. The driving transistor T1 is electrically connected to the light emitting element 20, and outputs a driving current, under the control of signals such as the scan signal Scan, the data signal Data, the first voltage signal ELVDD, and the second voltage signal ELVSS, etc., to drive the light emitting element 20 to emit light.

For example, as shown in FIG. 1, the pixel circuit structure 10 further includes a first stabilization capacitor C1 between the data line 12 and the voltage signal line, and the voltage signal line shown in FIG. 1 refers to the first power line 13. When the data signal Data on the data line 12 changes, the first stabilization capacitor C1 can reduce the interference of the parasitic capacitance between the data line 12 and the gate electrode of the driving transistor T1 to the gate signal of the driving transistor T1.

In a practical case, for example, a capacitance value of the first stabilization capacitor C1 can be designed to be equal to or greater than 10 times of the parasitic capacitance between the data line 12 and the gate electrode of the driving transistor T1. In a case where the capacitance value of the parasitic capacitance can be neglected compared with that of the first stabilization capacitor C1, the influence of the data line signal on the gate signal through the parasitic capacitance is also negligible.

The first stabilization capacitor C1 can be arranged in a variety of ways. For example, the first stabilization capacitor can include a first capacitor electrode and a second capacitor electrode, the first capacitor electrode is electrically connected to the first power source line 13, and the second capacitor electrode is electrically connected to the data line 12. It should be noted that, the first capacitor electrode can be a part of the first power line 13 or an electrode that is separately provided and electrically connected to the first power line 13, both of which are included in the scope of "the first capacitor electrode is electrically connected to the first power source line" mentioned above. Similarly, the second capacitor electrode can be a part of the data line 12 or an electrode that is separately provided and electrically connected to the data line 12, both of which are included in the scope of "the second capacitor electrode is electrically connected to the data line" mentioned above.

For example, in a preparation process, a pixel circuit structure is prepared on a substrate of the display panel 100 by semiconductor techniques, and the pixel circuit structure includes a circuit layer, an insulation layer and the like that are stacked. The first capacitor electrode and the second capacitor electrode can overlap with each other in a direction perpendicular to the substrate of the display panel 100, and are spaced apart from each other by the insulation layer (a dielectric layer), thereby forming a capacitor. In a practical design, the capacitance value of the first stabilization capacitor C1 can be adjusted by designing a distance between the first capacitor electrode and the second capacitor electrode, a material of the intermediate insulation layer (i.e., a dielectric constant), and an overlapping area between the first capacitor electrode and the second capacitor electrode.

As shown in FIG. 1, a first electrode of the storage capacitor Cst is electrically connected to the first power line 13, and a second electrode of the storage capacitor Cst is electrically connected to a second electrode of the compensation transistor T3. A gate electrode of the data writing transistor T2 is electrically connected to the gate line 11, a first electrode and a second electrode of the data writing transistor T2 are electrically connected to the data line 12 and a first electrode of the driving transistor T1, respectively. A gate electrode of the compensation transistor T3 is electrically connected to the gate line 11, the first electrode and a second electrode of the compensation transistor T3 are electrically connected to a second electrode and a gate electrode of the driving transistor T1, respectively. A gate electrode of the first light emitting control transistor T4 is electrically connected to the light emitting control signal line 15, a first electrode and a second electrode of the first light emitting control transistor T4 are electrically connected to the first power line 13 and the first electrode of the driving transistor T1, respectively. A gate electrode of the second light emitting control transistor T5 is electrically connected to the light emitting control signal line 15, a first electrode and a second electrode of the second light emitting control transistor T5 are electrically connected to the second electrode of the driving transistor T1 and a first electrode of the light emitting element 20, respectively. A gate electrode of the first reset transistor T6 is electrically connected to the reset control signal line 17, a first electrode and a second electrode of the first reset transistor T6 are electrically connected to the initialization signal line 16 and the gate electrode of the driving transistor T1, respectively. A gate electrode of the second reset transistor T7 is electrically connected to the reset control signal line 17, a first electrode and a second electrode of the second reset transistor T7 are electrically connected to the initialization signal line 16 and the first electrode of the light emitting element 20, respectively. A second electrode of the light emitting element 20 is electrically connected to the second power line 14. It should be noted that the transistors used in the embodiments of the present disclosure can be thin film transistors or field effect transistors or other switching devices having the same characteristics. A source electrode and a drain electrode of a transistor used here can be symmetrical in structure, so that the source electrode and the drain electrode can be indistinguishable in structure. In the embodiments of the present disclosure, in order to distinguish the two electrodes of a transistor other than the gate electrode, one of the two electrodes is directly described as a first electrode while the other of the two electrodes is directly described as a second electrode, so the first and second electrodes of all or a part of the transistors in the embodiments of the present disclosure are interchangeable as needed. For example, the first electrode of the transistors in the embodiments of the present disclosure can be a source electrode, and the second electrode thereof can be a drain electrode; alternatively, the first electrode of the transistors is a drain electrode, and the second electrode thereof is a source electrode.

In addition, the transistors can be divided into N-type and P-type transistors according to the characteristics of the transistors. The embodiments of the present disclosure are described by taking a case that the transistors are P-type transistors as an example. Based on the description and teaching of the implementations of the present disclosure, those skilled in the art can easily imagine that at least some of the transistors in the pixel circuit structure of the embodiments of the present disclosure can adopt an implementation of adopting a N-type transistor, that is, an implementation adopting N-type transistors or adopting a combination of N-type transistors and P-type transistors. Therefore, these implementations are also within the protection scope of the present disclosure.

For example, an active layer of the transistors adopted in the embodiments of the present disclosure can be made of mono-crystalline silicon, poly-crystalline silicon (e.g., low temperature poly-crystalline silicon), or a metal oxide semiconductor material (e.g., IGZO, AZO, etc.). In one example, the transistors are all P-type LTPS (low temperature poly-crystalline silicon) thin film transistors. In another example, the compensation transistor T3 (threshold compensation transistor) and the first reset transistor T6 that are directly connected to the gate electrode of the driving transistor T1 are metal oxide semiconductor thin film transistors, that is, a channel material of these transistors is a metal oxide semiconductor material (such as IGZO, AZO, etc.). The metal oxide semiconductor thin film transistors have a low leakage current, which can help reduce the gate leakage current of the driving transistor T1.

For example, the transistors adopted in the embodiments of the present disclosure can include various structures, such as a top gate type, a bottom gate type, or a double gate structure. In one example, the compensation transistor T3 and the first reset transistor T6 that are directly connected to the gate electrode of the driving transistor T1 are double gate thin film transistors, which can help reduce the gate leakage current of the driving transistor T1.

For example, as shown in FIG. 2, the display panel 100 provided by the embodiment of the present disclosure further includes: a data driver 102, a scan driver 103, and a controller 104. The data driver 102 is configured to provide a data signal Data to the pixel unit 101 according to an instruction of the controller 104; the scan driver 103 is configured to provide a light emitting control signal EM, a scan signal Scan, and a reset control signal Reset, etc., to the pixel unit 101 according to an instruction of the controller 104. For example, the scan driver 103 is a GOA (Gate On Array) structure mounted on the display panel, or a driver chip (IC) structure bonding to the display panel. For example, different drivers can be used to provide the light emitting control signal EM and the scan signal Scan, respectively. For example, the display panel 100 further includes a power source (not shown in FIG. 2) for providing the above voltage signal, which can be a voltage source or a current source as needed, and the power source is configured to supply the pixel unit 101 with the first power voltage ELVDD, the second power voltage ELVSS, and the initialization signal Vint, etc., through the first power line 13, the second power line 14, and the initialization signal line 16, respectively.

Figure 3:
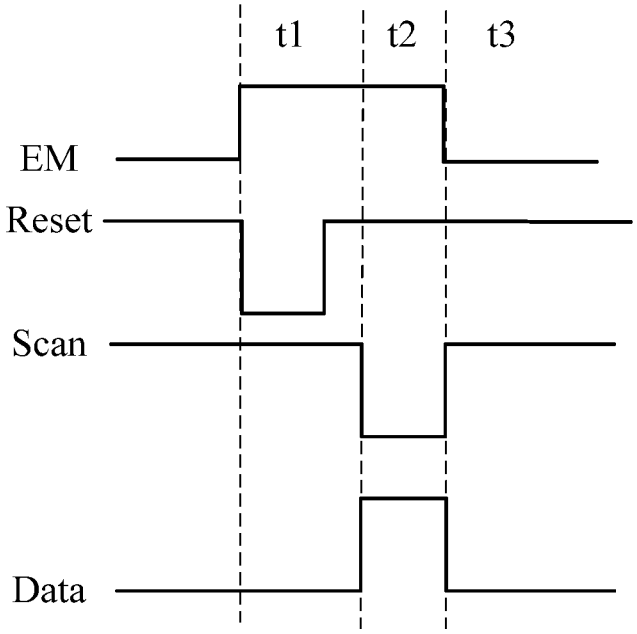
FIG. 3 is a timing signal diagram of a pixel unit in a display panel provided by an embodiment of the present disclosure.

FIG. 3 is a timing signal diagram of a pixel unit in a display panel provided by an embodiment of the present disclosure. A driving method of a pixel unit in the display panel provided by the embodiment of the present disclosure will be described below with reference to FIG. 3.

As shown in FIG. 3, in a display period of one frame, the driving method of the pixel unit includes a reset phase t1, a data writing and threshold compensating phase t2, and a light emitting phase t3.

In the reset phase t1, the light emitting control signal EM is set to be a turn-off voltage, the reset control signal Reset is set to be a turn-on voltage, and the scan signal Scan is set to be a turn-off voltage.

In the data writing and threshold compensating phase t2, the light emitting control signal EM is set to be a turn-off voltage, the reset control signal Reset is set to be a turn-off voltage, and the scan signal Scan is set to be a turn-on voltage.

In the light emitting phase t3, the light emitting control signal EM is set to be a turn-on voltage, the reset control signal Reset is set to be a turn-off voltage, and the scan signal Scan is set to be a turn-off voltage.

For example, in the embodiment of the present disclosure, the turn-on voltage refers to a voltage that enables the first electrode and the second electrode of the respective transistors to be turned on, and the turn-off voltage refers to a voltage that enables the first electrode and the second electrode of the respective transistors to be turned off. When the transistor is a P-type transistor, the turn-on voltage is a low voltage (for example, 0V), the turn-off voltage is a high voltage (for example, 5V); when the transistor is an N-type transistor, the turn-on voltage is a high voltage (for example, 5V), and the turned-off voltage is a low voltage (for example, 0V). The driving waveforms shown in FIG. 3 are all described by taking P-type transistors as an example, that is, the turn-on voltage is a low voltage (for example, 0 V), and the turn-off voltage is a high voltage (for example, 5 V).

Referring to FIG. 1 and FIG. 3 together, in the reset phase t1, the light emitting control signal EM is the turn-off voltage, the reset control signal Reset is the turn-on voltage, and the scan signal Scan is the turn-off voltage. At this time, the first reset transistor T6 and the second reset transistor T7 are in a turn-on state, while the data writing transistor T2, the compensation transistor T3, the first light emitting control transistor T4, and the second light emitting control transistor T5 are in a turn-off state. The initialization signal (initialization voltage) Vint is transmitted to the gate electrode of the driving transistor T1 through the first reset transistor T6, and is stored by the storage capacitor Cst, so as to reset the driving transistor T1 and eliminate data stored during a previous light emitting (a previous frame); the initialization signal Vint is transmitted to the first electrode of the light emitting element 20 through the second reset transistor T7, so as to reset the light emitting element 20.

In the data writing and threshold compensating phase t2, the light emitting control signal EM is the turn-off voltage, the reset control signal Reset is the turn-off voltage, and the scan signal Scan is the turn-on voltage. At this time, the data writing transistor T2 and the compensation transistor T3 are in a turn-on state, while the first light emitting control transistor T4, the second light emitting control transistor T5, the first reset transistor T6, and the second reset transistor T7 are in a turn-off state. At this time, the data writing transistor T2 transmits the data signal voltage Vdata to the first electrode of the driving transistor T1, that is, the data writing transistor T2 receives the scan signal Scan and the data signal Data, and writes the data signal Data to the first electrode of the driving transistor T1 according to the scan signal Scan. The compensation transistor T3 is turned on to connect the driving transistor T1 into a diode structure, whereby the gate electrode of the driving transistor T1 can be charged. After the charging is completed, the gate voltage of the driving transistor T1 is Vdata+Vth, where Vdata is the data signal voltage, and Vth is the threshold voltage of the driving transistor T1. That is, the compensation transistor T3 receives the scan signal Scan and performs threshold voltage compensation on the gate voltage of the driving transistor T1 according to the scan signal Scan. In this phase, the voltage difference between two terminals of the storage capacitor Cst is ELVDD−Vdata−Vth.

In the light emitting phase t3, the light emitting control signal EM is the turn-on voltage, the reset control signal Reset is the turn-off voltage, and the scan signal Scan is the turn-off voltage. The first light emitting control transistor T4 and the second light emitting control transistor T5 are in a turn-on state, while the data writing transistor T2, the compensation transistor T3, the first reset transistor T6, and the second reset transistor T7 are in a turn-off state. The first power signal ELVDD is transmitted to the first electrode of the driving transistor T1 through the first light emitting control transistor T4, the gate voltage of the driving transistor T1 is maintained at Vdata+Vth, and the driving current I flows into the light emitting element 20 through the first light emitting control transistor T4, the driving transistor T1 and the second light emitting control transistor T5, and the light emitting element 20 emits light. That is, the first light emitting control transistor T4 and the second light emitting control transistor T5 receive the light emitting control signal EM, and control the light emitting element 20 to emit light according to the light emitting control signal EM. The driving current I satisfies the saturation current formula as follows:

$$K(Vgs-Vth)^2=K(Vdata+Vth-ELVDD-Vth)^2=K(Vdata-ELVDD)^2$$

where $$K = 0.5\ \mu_n Cox\frac{W}{L},$$

$\mu_n$ the channel mobility of the driving transistor, Cox is the channel capacitance per unit area of the driving transistor T1, W and L are the channel width and the channel length of the driving transistor T1, respectively, and Vgs is the voltage difference between the gate electrode and the source electrode (that is, the first electrode of the driving transistor T1 in the present embodiment)) of the driving transistor T1.

It can be seen from the above formula that the current flowing through the light emitting element 20 is independent of the threshold voltage of the driving transistor T1. Therefore, the pixel circuit structure compensates for the threshold voltage of the driving transistor T1 very well.

For example, in the pixel array of the display panel, for convenience of wiring, the reset control signal line 17 can be set as a gate line of a previous row of pixel units, that is, the reset control signal is served by a scan signal Scan(n−1) of the previous row of pixel units, thereby reducing wiring and the number of signals.

For example, the ratio of the duration of the light emitting phase t3 to the display period of one frame can be adjusted. In this way, the luminous brightness can be controlled by adjusting the ratio of the duration of the light emitting phase t3 to the display period of one frame. For example, by controlling the scan driver 103 in the display panel or a driver additionally provided, the ratio of the duration of the light emitting phase t3 to the display period of one frame can be adjusted.

For example, in other examples, the first stabilization capacitor C1 can also be located between the data line 12 and another signal line that provides a constant voltage signal. For example, the first stabilization capacitor C1 is located between the data line 12 and the second power line 14, or the first stabilization capacitor C1 is located between the data line 12 and the initialization signal line 16. In other examples, the first light emitting control transistor T4 or the second light emitting control transistor T5 may not be provided, or, the first reset transistor T6 or the second reset transistor T7 may not be provided. That is, the embodiment of the present disclosure is not limited to the specific pixel circuit shown in FIG. 1, and other pixel circuits that enable compensation for the driving transistor can be adopted. Based on the description and teaching of the implementation of the present disclosure, other arrangements that can be easily conceived by those skilled in the art without creative efforts are within the protection scope of the present disclosure.

Figure 4:
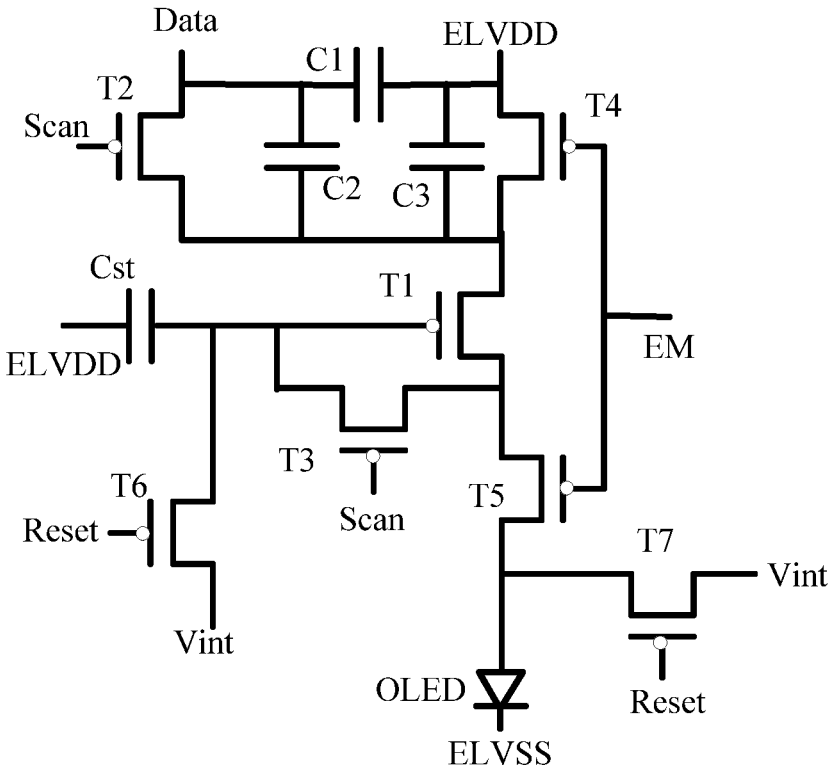
FIG. 4 is a schematic structural diagram of a display panel provided by another embodiment of the present disclosure.

FIG. 4 is a schematic diagram of a display panel provided by another embodiment of the present disclosure. As shown in FIG. 4, the display panel provided by the present embodiment differs from the display panel in FIG. 1, the display panel 100 further includes a second stabilization capacitor C2 and/or a third stabilization capacitor C3. The second stabilization capacitor C2 is located between the data line 12 and the first electrode of the driving transistor T1, and the third stabilization capacitor C3 is located between the first power source line 13 and the first electrode of the driving transistor T1. Because the presence of the second stabilization capacitor C2, the interference of the parasitic capacitance between the data line 12 and the gate electrode of the driving transistor T1 to the gate signal of the driving transistor T1 can be further reduced. Because the presence of the third stabilization capacitor C3, the interference of the parasitic capacitance between the first power line 13 and the gate electrode of the driving transistor T1 to the gate signal of the driving transistor T1 can be further reduced.

Figure 5:
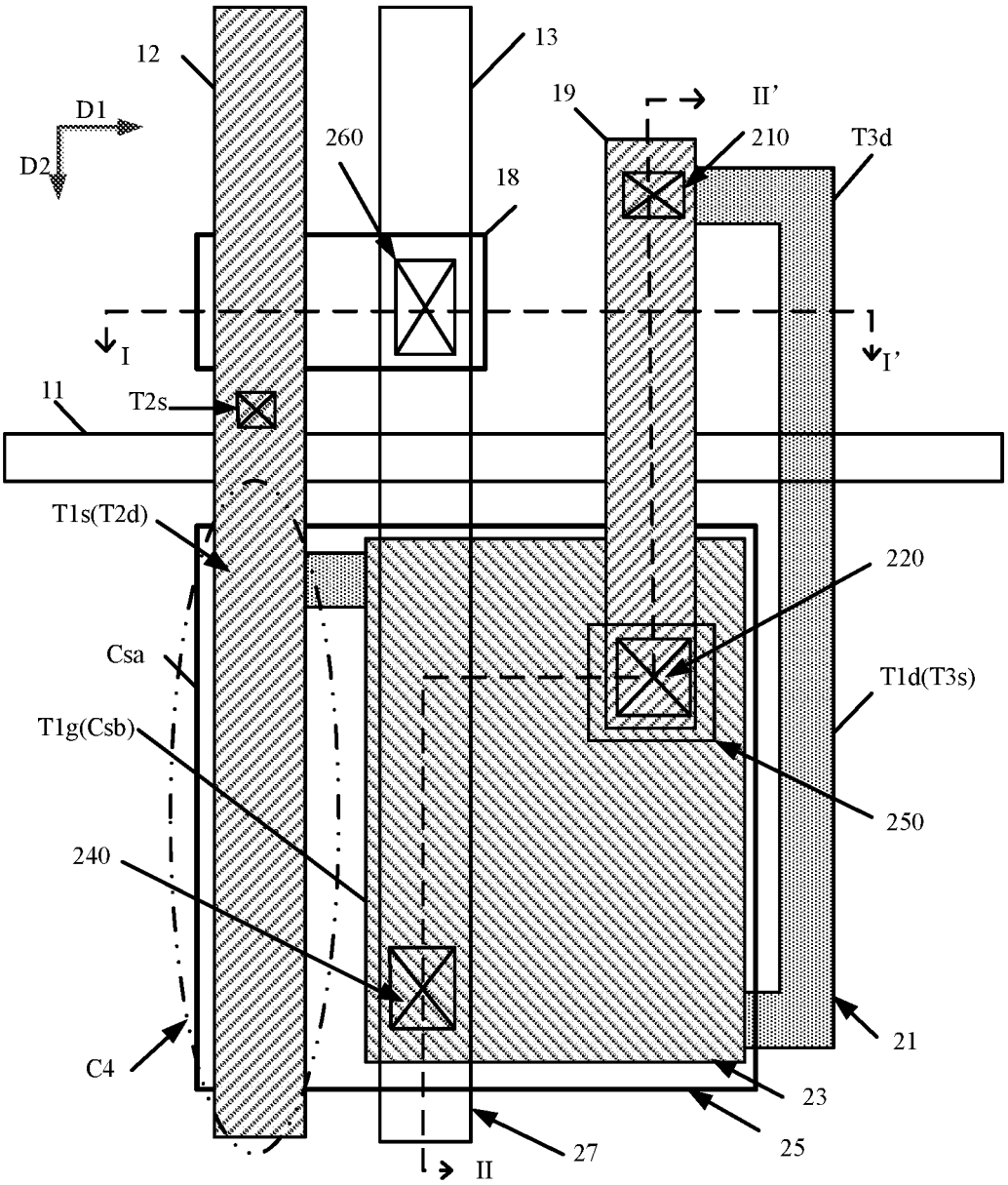
FIG. 5 is a schematic plan view of a display panel provided by an embodiment of the present disclosure.
Figure 6:
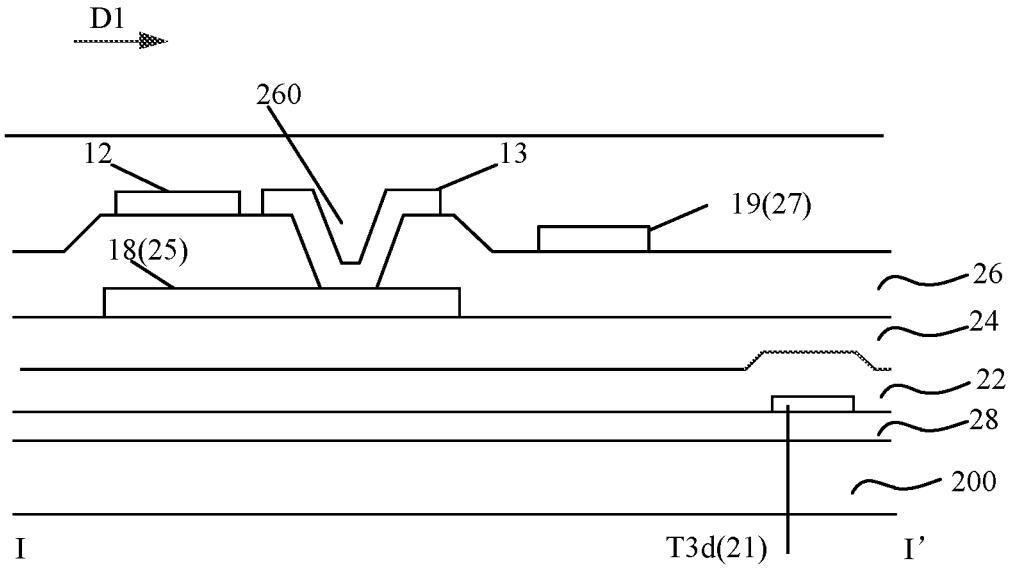
FIG. 6 is a cross-sectional view of the display panel shown in FIG. 5 taken along section line I-I'.
Figure 7:
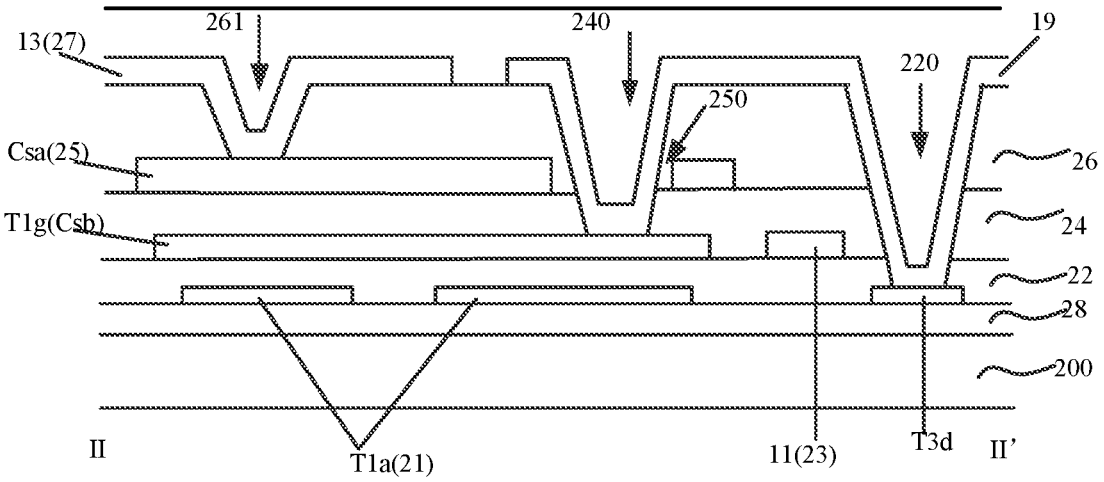
FIG. 7 is a cross-sectional view of the display panel shown in FIG. 5 taken along section line II-II'.

FIG. 5 is a schematic plan view (exemplary layout) of the display panel 100 of FIG. 1. For clarity, only the structures of the driving transistor T1, the data writing transistor T2, the compensation transistor T3, the storage capacitor Cst and the first stabilization capacitor C1 is shown, and the structures of other transistors are not shown. FIG. 6 is a cross-sectional view of the display panel shown in FIG. 5 taken along section line I-I', and FIG. 7 is a cross-sectional view of the display panel shown in FIG. 5 taken along section line II-II'. The display panel 100 provided by the embodiment of the present disclosure will be exemplarily described below with reference to FIGS. 5-7.

It should be noted that "disposed in the same layer" as illustrated in the present disclosure refers to that two (or more than two) material layer structures are formed by the same deposition process and patterned by the same patterning process, so the two (more than two) have the same material.

It should also be noted that an electrical connection between A and B as illustrated in the present disclosure includes a case where A is a part of B and a case where B is a part of A.

For convenience of description, in the figures and in the following description, T1*g*, T1*s*, T1*d* and T1*a*, are used to represent the gate electrode, the first electrode, the second electrode, and the channel region of the driving transistor T1, respectively; T2*g*, T2*s*, T2*d* and T2*a*, are used to represent the gate electrode, the first electrode, the second electrode, and the channel region of the data writing transistor T2, respectively; T3*g*, T3*s*, T3*d* and T3*a*, are used to represent the gate electrode, the first electrode, the second electrode, and the channel region of the compensation transistor T3, respectively; Csa and Csb are used to represent the first electrode and the second electrode of the storage capacitor, respectively.

As shown in the figures, the display panel 100 includes a substrate 200, and a semiconductor pattern layer 21, a first insulation layer 22, a first conductive pattern layer 23, a second insulation layer 24, a second conductive pattern layer 25, an interlayer insulation layer 26 and a third conductive pattern layer 27, that are sequentially stacked on the substrate 200.

For example, the semiconductor pattern layer 21 includes an active layer of the driving transistor T1, an active layer of the data writing transistor T2, and an active layer of the compensation transistor T3.

For example, the first conductive pattern layer 23 includes the gate line 11, the second electrode Csb of the storage capacitor Cst, the gate electrode T1*g* of the driving transistor T1, the gate electrode T2*g* of the data writing transistor, and the gate electrode T3*g* of the compensation transistor.

For example, the second conductive pattern layer 25 includes the first electrode Csa of the storage capacitor Cst.

For example, the first electrode Csa of the storage capacitor Cst and the gate electrode T1*g* of the driving transistor T1 overlap with each other in a direction perpendicular to the substrate 200.

For example, the third conductive pattern layer 27 includes the data line 12 and the first power line 13.

As shown in the figures, the gate line 11 extends in a first direction D1, and the data line 12 and the first power line 13 extend in a second direction D2 and are disposed in the same layer. For example, the first direction D1 and the second direction D2 are substantially perpendicular to each other.

In the present embodiment, the first stabilization capacitor C1 includes a first capacitor electrode 18 that is separately provided and is electrically connected to the first power line 13, and a second capacitor electrode of the first stabilization capacitor C1 is served by a part of the data line 12 itself. In other embodiments, the second capacitor electrode can also be separately provided as an electrode connected to the data line 12.

For example, the first capacitor electrode 18 is located on a side of the data line 12 close to the substrate 200 and is disposed in the same layer as the first capacitor electrode Csa of the storage capacitor Cst. The first capacitor electrode 18 is electrically connected to the first power line 13 through a first via hole 260 penetrating through the interlayer insulation layer 26. The first capacitor electrode 18 and the data line 12 overlap with each other in the direction perpendicular to the substrate 200, thereby forming the first stabilization capacitor C1.

For example, in a manufacturing process of the display panel 100, by adopting a self-alignment technique, the semiconductor pattern layer 21 is subjected to a conductor treatment using the first conductive pattern layer 23 as a mask. For example, the semiconductor pattern layer 21 is heavily doped by ion implantation, so that a portion of the semiconductor pattern layer 21 not covered by the first conductive pattern layer 23 is made conductive, thereby forming a source region (first electrode T1*s*) and a drain region (second electrode T1*d*) of the driving transistor T1, and a source region (first electrode T2*s*) and a drain region (second electrode T2*d*) of the data writing transistor T2, and a source region (first electrode T3*s*) and a drain region (second electrode T3*d*) of the compensation transistor T3. A portion of the semiconductor pattern layer 21 covered by the first conductive pattern layer 23 retains semiconductor characteristics, thereby forming channel regions T1*a*, T2*a*, and T3*a* of the respective transistors.

For example, the display panel 100 further includes a first connecting electrode 19, and the first connecting electrode 19 is configured to connect the drain region (second electrode region) of the compensation transistor T3 and the gate electrode T1*g* of the driving transistor T1, thereby electrically connecting the second electrode T3*d* of the compensation transistor T3 to the gate electrode T1*g* of the driving transistor T1.

For example, the first connecting electrode 19 is disposed in the same layer as the data line 12 and extends in the same direction as the data line 12.

Referring to FIG. 5 and FIG. 6 together, because the data line 12, the first connecting electrode 19 and the second electrode T3*d* of the compensation transistor T3 have parasitic capacitances between one another, by disposing the first capacitor electrode 18 at a side of the data line 12 close to the substrate 200, the first capacitor electrode can function to raise the data line, and can increase a distance between a side surface of the data line 12 and a side surface of the first connecting electrode 19, and a distance between the side surface of the data line 12 and a side surface of the second electrode T3*d* of the compensation transistor T3, thereby reduce the parasitic capacitances. For example, because the second electrode T3*d* of the compensation transistor T3 is directly connected to the gate electrode of the driving transistor T1, a case of reducing the parasitic capacitances helps to reduce the interference of the data line to the gate signal of the driving transistor T1.

For example, an orthographic projection of the first connecting electrode 19 on the layer where the first capacitor electrode 18 is located (i.e., the second conductive pattern layer 25) and the first capacitor electrode 18 overlap with each other in a direction perpendicular to the extending direction of the data line 12 (i.e., the first direction D1).

For example, referring to FIG. 6, an orthographic projection of the first connecting electrode 19 on the layer where the first capacitor electrode 18 is located (i.e., the second conductive pattern layer 25) and the first capacitor electrode 18 overlap with each other in a direction perpendicular to the extending direction of the data line 12 (i.e., the first direction D1).

For example, an opening 250 is disposed on the first electrode Csa of the storage capacitor Cst, and the first connecting electrode 19 is electrically connected to the gate electrode T1*g* of the driving transistor T1 (i.e., the second electrode Csb of the storage capacitor Cst) through the opening 250 and a second via hole 240 penetrating through the second insulation layer 24 and the interlayer insulation layer 26.

For example, the first connecting electrode 19 is electrically connected to the second electrode T3*d* of the compensation transistor T3 through a third via hole 220 penetrating through the first insulation layer 22, the second insulation layer 24, and the interlayer insulation layer 26.

For example, the first power line 13 is electrically connected to the first electrode Csa of the storage capacitor Cst through a fourth via 261 penetrating through the interlayer insulation layer 26.

For example, referring to FIG. 5, the first electrode Csa of the storage capacitor Cst and the data line 12 overlap with each other in the direction perpendicular to the substrate, thereby forming a fourth stabilization capacitor C4. Because the first electrode Csa of the storage capacitor Cst is electrically connected to the first power line 13, the fourth stabilization capacitor C4 is also formed between the first power line and the data line, thereby further reducing the interference of the parasitic capacitance between the data line 12 and the gate electrode of the driving transistor T1 to the gate signal of the driving transistor T1.

For example, a material of the first insulation layer 22, the second insulation layer 24 and the interlayer insulation layer 26, can include an inorganic insulation material such as silicon nitride, silicon oxynitride, etc., or aluminum oxide, titanium nitride, etc. For example, the insulation material can further include an organic insulation material such as acrylic acid or polymethyl methacrylate (PMMA), etc. For example, the insulation layer can be a monolayer structure or a multilayer structure.

For example, materials of the first conductive pattern layer 23, the second conductive pattern layer 25 and the third conductive pattern layer 27, include gold (Au), silver (Ag), copper (Cu), aluminum (Al), molybdenum (Mo), magnesium (Mg), tungsten (W), and an alloy material composed of the above metals; or a conductive metal oxide material such as indium tin oxide (ITO), indium zinc oxide (IZO), zinc oxide (ZnO), zinc aluminum oxide (AZO), etc.

For example, the display panel 100 can further include a buffer layer 28 between the substrate 200 and the semiconductor pattern layer 21.

For example, the substrate 200 is a glass substrate, and a material of the buffer layer 28 is silicon dioxide, so as to prevent impurities (metal ions) in the substrate 200 from diffusing into the pixel circuit structure.

For example, the display panel provided by the embodiments of the present disclosure can be applied to any product or component having a display function, such as a mobile phone, a tablet computer, a television, a display, a notebook computer, a digital photo frame, a navigator, etc. For example, the display panel is an organic light emitting diode display panel.

The embodiments of the present disclosure also provide a display device, which includes the above display panel. For example, the display device can be an electronic device that applies the display panel, such as a mobile phone, a tablet computer, a television, a display, a notebook computer, a digital photo frame, a navigator, etc. For example, the display device is an organic light emitting diode display device.

Although the present disclosure has been described in detail above with general descriptions and specific embodiments, some modifications or improvements can be made on the basis of the embodiments of the present disclosure, which is apparent to those skilled in the art. Therefore, such modifications or improvements made without departing from the spirit of the present disclosure are intended to fall within the protection scope of the present disclosure.

The following statements should be noted:

(1) The accompanying drawings involve only the structure(s) in connection with the embodiment(s) of the present disclosure, and other structure(s) can be referred to common design(s).

(2) In case of no conflict, features in one embodiment or in different embodiments can be combined.

What have been described above are only specific implementations of the present disclosure, the protection scope of the present disclosure is not limited thereto. Any changes or substitutions easily occur to those skilled in the art within the technical scope of the present disclosure should be covered in the protection scope of the present disclosure. Therefore, the protection scope of the present disclosure should be based on the protection scope of the claims.

What is claimed is:

1. A display panel, comprising a pixel circuit structure, a data line and a voltage signal line, wherein the data line is connected to the pixel circuit structure to provide a data signal;

the voltage signal line is connected to the pixel circuit structure to provide a voltage signal, the voltage signal is a constant voltage signal;

the pixel circuit structure comprises a first stabilization capacitor provided directly between the data line and the voltage signal line and a driving transistor; and a capacitance value of the first stabilization capacitor is equal to or greater than 10 times of a capacitance value of a parasitic capacitance between the data line and a gate electrode of the driving transistor.

2. The display panel according to claim 1, further comprising: a gate line and a light emitting element, wherein the gate line is connected to the pixel circuit structure to provide a scan signal; the driving transistor is electrically connected to the light emitting element and outputs a driving current to drive the light emitting element to emit light under control of the scan signal and the data signal.

3. The display panel according to claim 2, wherein the first stabilization capacitor comprises a first capacitor electrode and a second capacitor electrode, the first capacitor electrode is electrically connected to the voltage signal line, and the second capacitor electrode is electrically connected to the data line.

4. The display panel according to claim 3, further comprising a substrate, wherein the pixel circuit structure, the gate line, the data line and the voltage signal line are on the substrate, the first capacitor electrode and the second capacitor electrode overlap with each other in a direction perpendicular to the substrate.

5. The display panel according to claim 4, wherein the voltage signal line and the data line are disposed in a same layer and extend in a same direction, the first capacitor electrode is located on a side of the data line close to the substrate;

the display panel further comprises an interlayer insulation layer between the data line and the first capacitor electrode, the first capacitor electrode is connected to the voltage signal line through a via hole penetrating through the interlayer insulation layer.

6. The display panel according to claim 4, further comprising a compensation transistor, wherein a first electrode and a second electrode of the driving transistor are respectively connected to the voltage signal line and the light emitting element;

a first electrode and a second electrode of the compensation transistor are respectively connected to the second electrode and a gate electrode of the driving transistor, and a gate electrode of the compensation transistor is connected to the gate line.

7. The display panel according to claim 6, wherein the compensation transistor comprises an active layer, the active layer comprises a first electrode region, a second electrode region, and a channel region between the first electrode region and the second electrode region, the first electrode region and the second electrode region are conductive regions, the display panel further comprises a first connecting electrode, the first connecting electrode connects the second electrode region and the gate electrode of the driving transistor.

8. The display panel according to claim 7, wherein the pixel circuit structure further comprises a storage capacitor, a first electrode and a second electrode of the storage capacitor are electrically connected to the voltage signal line and the gate electrode of the driving transistor, respectively;

the first electrode of the storage capacitor is disposed in the same layer as the first capacitor electrode, and overlaps with the gate electrode of the driving transistor in the direction perpendicular to the substrate.

9. The display panel according to claim 8, wherein the first electrode of the storage capacitor and the data line overlap with each other in the direction perpendicular to the substrate.

10. The display panel according to claim 8, wherein the first electrode of the storage capacitor is provided with an opening, and the first connecting electrode is electrically connected to the gate electrode of the driving transistor through the opening.

11. The display panel according to claim 7, wherein the pixel circuit structure further comprises a second stabilization capacitor, the second stabilization capacitor is located between the data line and the first electrode of the driving transistor, or the second stabilization capacitor is located between the voltage signal line and the first electrode of the driving transistor; or, the pixel circuit structure further comprises a second stabilization capacitor and a third stabilization capacitor, one of the second stabilization capacitor and the third stabilization capacitor is located between the data line and the first electrode of the driving transistor, and the other of the second stabilization capacitor and the third stabilization capacitor is located between the voltage signal line and the first electrode of the driving transistor.

12. The display panel according to claim 7, further comprising a light emitting control signal line, a reset control signal line and an initialization signal line, the pixel circuit structure further comprising a data writing transistor, a first light emitting control transistor, a second light emitting control transistor, a first reset transistor and a second reset transistor, wherein a first electrode and a second electrode of the data writing transistor are electrically connected to the data line and the first electrode of the driving transistor, respectively, and a gate electrode of the data writing transistor is electrically connected to the gate line;

a gate electrode of the first light emitting control transistor is electrically connected to the light emitting control signal line, a first electrode and a second electrode of the first light emitting control transistor are electrically connected to the voltage signal line and the first electrode of the driving transistor, respectively;

a gate electrode of the second light emitting control transistor is electrically connected to the light emitting control signal line, a first electrode and a second electrode of the second light emitting control transistor are electrically connected to the second electrode of the driving transistor and the first electrode of the light emitting element, respectively;

a gate electrode of the first reset transistor is electrically connected to the reset control signal line, a first electrode and a second electrode of the first reset transistor are electrically connected to the initialization signal line and the gate electrode of the driving transistor, respectively;

a gate electrode of the second reset transistor is electrically connected to the reset control signal line, a first electrode and a second electrode of the second reset transistor are electrically connected to the initialization signal line and the first electrode of the light emitting element, respectively.

13. The display panel according to claim 1, wherein the voltage signal line comprises a power line.

14. A display panel, comprising a substrate, and a pixel circuit structure, a light emitting element, a gate line, a data line, a first power line, a second power line, a light emitting control signal line, an initialization signal line and a reset control signal line on the substrate, the pixel circuit structure comprising a storage capacitor, a driving transistor, a data writing transistor, a compensation transistor, a first light emitting control transistor, a second light emitting control transistor, a first reset transistor and a second reset transistor, wherein a first electrode of the storage capacitor is electrically connected to the first power line, and a second electrode of the storage capacitor is electrically connected to a second electrode of the compensation transistor through a first connecting electrode;

a gate electrode of the data writing transistor is electrically connected to the gate line, a first electrode and a second electrode of the data writing transistor are electrically connected to the data line and a first electrode of the driving transistor, respectively;

a gate electrode of the compensation transistor is electrically connected to the gate line, and a first electrode and the second electrode of the compensation transistor are electrically connected to a second electrode and a gate electrode of the driving transistor, respectively;

a gate electrode of the first light emitting control transistor is electrically connected to the light emitting control signal line, a first electrode and a second electrode of the first light emitting control transistor are electrically connected to the first power line and the first electrode of the driving transistor, respectively;

a gate electrode of the second light emitting control transistor is electrically connected to the light emitting control signal line, a first electrode and a second electrode of the second light emitting control transistor are electrically connected to the second electrode of the driving transistor and the first electrode of the light emitting element, respectively;

a gate electrode of the first reset transistor is electrically connected to the reset control signal line, a first electrode and a second electrode of the first reset transistor are electrically connected to the initialization signal line and the gate electrode of the driving transistor, respectively;

a gate electrode of the second reset transistor is electrically connected to the reset control signal line, a first electrode and a second electrode of the second reset transistor are electrically connected to the initialization signal line and the first electrode of the light emitting element, respectively;

a second electrode of the light emitting element is electrically connected to the second power line;

the pixel circuit structure further comprises a first stabilization capacitor located between the data line and the first power line, the first stabilization capacitor comprises a first capacitor electrode, and the first power line is configured to provide a constant voltage signal for the pixel circuit structure; and a capacitance value of the first stabilization capacitor is equal to or greater than 10 times of a capacitance value of a parasitic capacitance between the data line and a gate electrode of the driving transistor.

15. The display panel according to claim 14, wherein the gate line, the gate electrode of the driving transistor and the second electrode of the storage transistor are disposed in a same layer;

the first capacitor electrode, the initialization signal line and the first electrode of the storage transistor are disposed in a same layer;

the data line, the first power line and the first connecting electrode are disposed in a same layer; and the first capacitor electrode and the data line overlap with each other in a direction perpendicular to the substrate.

16. The display panel according to claim 14, wherein the compensation transistor and the first reset transistor are metal oxide semiconductor thin film transistors or double gate thin film transistors.

17. The display panel according to claim 14, wherein the first capacitor electrode is electrically connected to the first power line, the first stabilization capacitor further comprises a second capacitor electrode, the second capacitor electrode is electrically connected to the data line, the first capacitor electrode and the second capacitor electrode overlap with each other in a direction perpendicular to the substrate.

18. The display panel according to claim 14, wherein the first capacitor electrode is located on a side of the data line close to the substrate;

the display panel further comprises an interlayer insulation layer between the data line and the first capacitor electrode, and the first capacitor electrode is connected to the first power line through a via hole penetrating through the interlayer insulation layer.

19. A display device, comprising the display panel according to claim 1.

* * * * *